US007641440B2

(12) United States Patent
Morrison et al.

(10) Patent No.: US 7,641,440 B2
(45) Date of Patent: Jan. 5, 2010

(54) COOLING ARRANGEMENT FOR CMC COMPONENTS WITH THERMALLY CONDUCTIVE LAYER

(75) Inventors: Jay A. Morrison, Oviedo, FL (US); Jay E. Lane, Mims, FL (US)

(73) Assignee: Siemens Energy, Inc., Orlando, FL (US)

( * ) Notice: Subject to any disclaimer, the term of this patent is extended or adjusted under 35 U.S.C. 154(b) by 496 days.

(21) Appl. No.: 11/514,745

(22) Filed: Aug. 31, 2006

(65) Prior Publication Data

US 2009/0238684 A1 Sep. 24, 2009

(51) Int. Cl.
*F01D 5/18* (2006.01)

(52) U.S. Cl. ..... 415/116; 415/173.4; 415/174.4; 415/200; 416/241 B

(58) Field of Classification Search ..... 415/116, 415/173.4, 174.4, 200; 416/241 B
See application file for complete search history.

(56) References Cited

U.S. PATENT DOCUMENTS

| | | | | |
|---|---|---|---|---|
| 4,519,745 | A | 5/1985 | Rosman et al. | |
| 4,629,397 | A | 12/1986 | Schweitzer | |
| 5,296,288 | A | 3/1994 | Kourtides et al. | |
| 5,516,260 | A | 5/1996 | Damlis et al. | |
| 5,720,597 | A | 2/1998 | Wang et al. | |
| 5,820,337 | A | 10/1998 | Jackson et al. | |
| 6,197,424 | B1 | 3/2001 | Morrison et al. | |
| 6,241,469 | B1 | 6/2001 | Beeck et al. | |
| 6,284,390 | B1 | 9/2001 | Bose et al. | |
| 6,316,048 | B1 | 11/2001 | Steibel et al. | |
| 6,514,046 | B1 | 2/2003 | Morrison et al. | |
| 6,554,563 | B2 | 4/2003 | Noe et al. | |
| 6,709,230 | B2 | 3/2004 | Morrison et al. | |
| 6,733,907 | B2 * | 5/2004 | Morrison et al. | 428/699 |
| 6,758,653 | B2 * | 7/2004 | Morrison | 415/173.4 |
| 6,767,659 | B1 | 7/2004 | Campbell | |
| 6,932,566 | B2 * | 8/2005 | Suzumura et al. | 415/135 |
| 2005/0220611 | A1 * | 10/2005 | Bhate et al. | 415/173.3 |

* cited by examiner

*Primary Examiner*—Igor Kershteyn

(57) ABSTRACT

A CMC wall (22) with a front surface (21) heated (24) by a working fluid in a gas turbine. A back CMC surface (23) is coated with a layer (42) of a thermally conductive material to accelerate heat transfer in the plane of the CMC wall (22), reducing thermal gradients (32-40) on the back CMC surface (23) caused by cold spots (32) resulting from impingement cooling flows (26). The conductive material (42) may have a coefficient of thermal conductivity at least 10 times greater than that of the CMC material (22), to provide a minimal thickness conductive layer (42). This reduces thermal gradient stresses within the CMC material (22), and minimizes differential thermal expansion stresses between the CMC material (22) and the thin conductive layer (42).

15 Claims, 4 Drawing Sheets

FIG 9
PRIOR ART
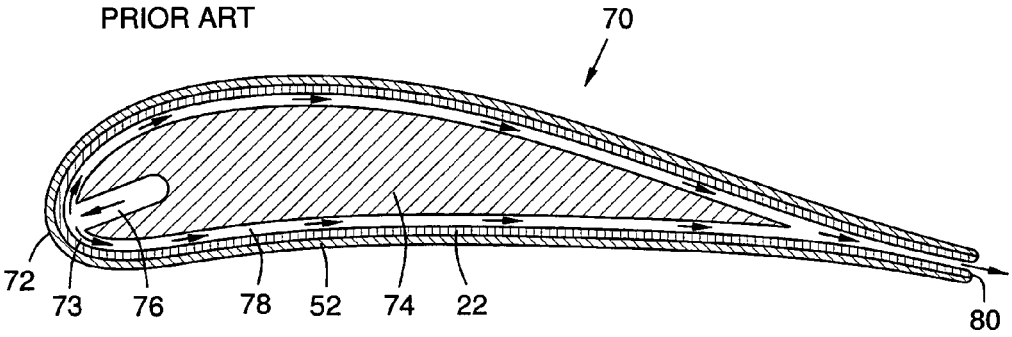
FIG 10
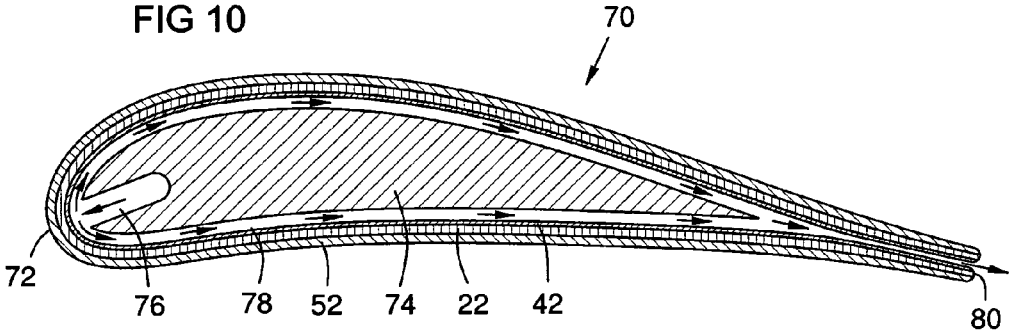
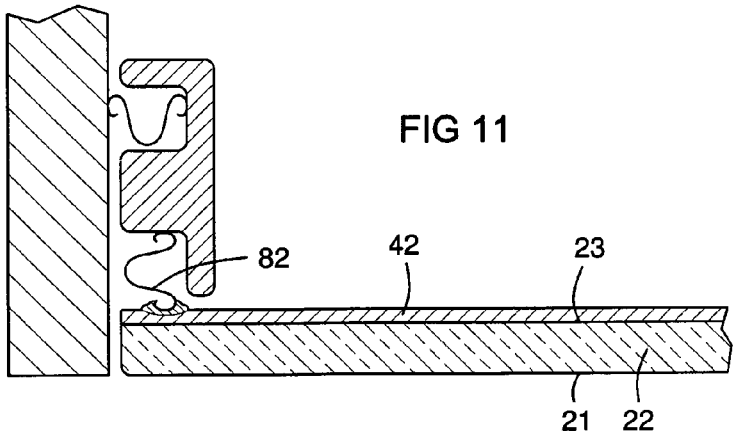
FIG 11

COOLING ARRANGEMENT FOR CMC COMPONENTS WITH THERMALLY CONDUCTIVE LAYER

FIELD OF THE INVENTION

The invention relates generally to the cooling of ceramic materials, and more particularly, to the cooling of ceramic matrix composite materials heated by a hot working gas flow in a gas turbine engine.

BACKGROUND OF THE INVENTION

Ceramic matrix composite (CMC) materials are used for high-temperature components such as gas turbine blades, vanes, and shroud surfaces. The walls of these components have a front surface that optionally may be coated with a ceramic insulating material and that is heated by the turbine combustion gas, and a back surface that is cooled by a cooling air flow. Cooling is accomplished by any of several conventional methods. For lower temperature applications, laminar backside cooling is effective; however, entry points for cooling air flow tend to have locally high heat transfer coefficients. For higher heat flux conditions, more aggressive cooling methods are required, including, for example, impingement cooling. Typically, impingement cooling is accomplished by directing jets of the cooling air toward the back side of the CMC wall in order to remove heat energy and to lower the temperature of the CMC material. For high thermal conductivity CMCs such as melt-infiltrated SiC/SiC composites and others, the adverse side effects from such impingement cooling are negligible. However, for low thermal conductivity CMCs such as the oxide-oxide classes of materials, the impingement method results in high in-plane thermal gradients on the cooled surface. Improved techniques for cooling ceramic materials used in high temperature applications are thus desired.

BRIEF DESCRIPTION OF THE DRAWINGS

The invention is explained in following description in view of the drawings that show:

FIG. 9 is a sectional view of a prior art turbine airfoil, showing impingement cooling from a plenum along and inside the leading edge followed by channel cooling along the pressure and suction walls of the airfoil, exiting the trailing edge.

FIG. 10 is a view as in FIG. 9 modified according to the invention with a conductive layer on the cooled side of the walls.

FIG. 11 is a sectional view of a CMC wall per the invention with a sealing member attached to a conductive layer.

DETAILED DESCRIPTION OF THE INVENTION

Figure 1:
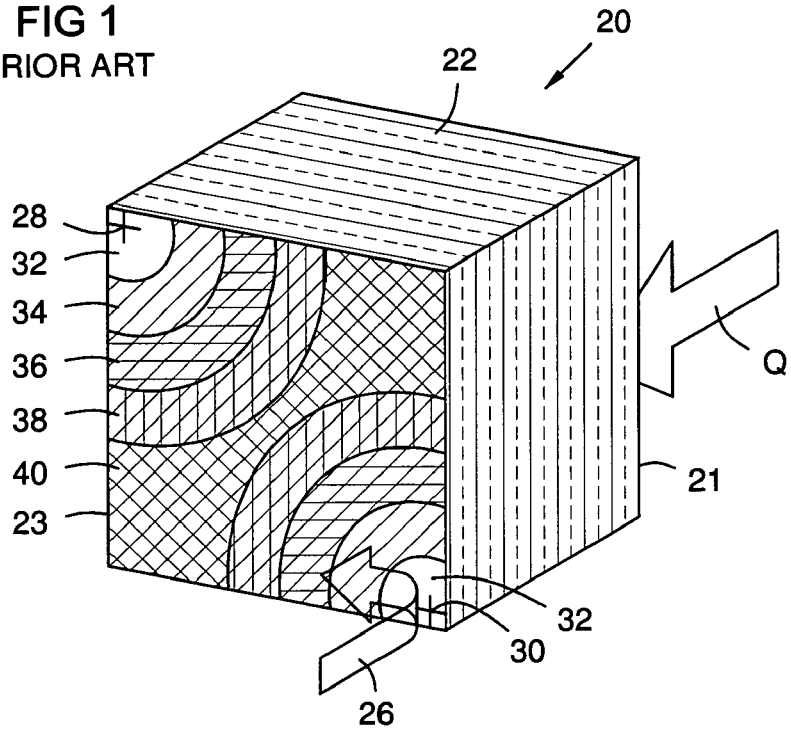
FIG 1 PRIOR ART
FIG. 1 is a schematic perspective view of a prior art section of a CMC wall with heating on one side and impingement cooling on the other.

FIG. 1 shows a section of a prior art component wall 20 made of CMC material 22 with a front surface 21 that is heated Q by a working fluid such as hot combustion gasses in a gas turbine engine. The arrow Q indicates heat flow, not gas flow. The hot working gasses flow generally along the front surface 21 and heat it generally evenly. The CMC material 22 has a back surface 23 that is cooled with one or more impingement flows 26 of a cooling fluid such as air bled from the turbine compressor. The arrow 26 indicates an impingement cooling fluid flow. An impingement flow 26 may be approximately orthogonal to the back surface 23. It differs from a laminar flow in that it strikes the surface 23 at one or more impingement points 28, 30 or lines, then flows generally radially away from each impingement point 28, 30 generally spreading out in opposite directions from an impingement line. FIG. 1 illustrates two impingement points 28, 30. The present inventors have found that each impingement flow 26 creates a relative cold spot 32, due to a locally high convection coefficient. This results in a sharp gradient of convection coefficients, represented here by a topography of hatched areas 32-40 of convection coefficients decreasing with radial distance (along the cooled surface) from each impingement point 28, 30. In the prior art, the ratio of maximum to minimum convection coefficients on a CMC component wall with impingement cooling can be greater than 5 to 1. This produces temperatures that increase with radial distance away from the impingement point such that area 40 is much hotter than area 32, causing thermal gradient stress. Thus, the cross-hatched areas 32-40 may be considered to represent heat transfer coefficient gradients or inversely to represent temperature gradients. While impingement cooling is known to be effective for cooling highly heat conductive materials such as metals, the present inventors have found that these locally high coefficients can result in excessive temperature gradients in low conductivity materials such as CMC. Local cold spots may develop where the cooling air directly impinges the CMC material and/or at locations of leakage of cooling air, such as around edges of structures or near seal locations. Undesirable thermal gradients and resultant thermal stresses have been found to arise from such inadvertent cold spots. Such thermal stresses may reduce component life and they represent an inefficient use of expensive cooling air. Accordingly, the present inventors have innovatively recognized the need for a cooling technique and apparatus that provides the cooling efficiency of impingement cooling but that also provides a more uniform temperature across the cooled surface of a CMC wall.

A heat transfer coefficient h is a number indicating an amount of heat Q that is exchanged across a unit area A of a boundary in a medium or system per unit time per unit difference in temperature $\Delta T$, as expressed in the equation $h=Q/(A*\Delta T)$. Metric units for h are $W\ m^{-2}\ K^{-1}$ or $J\ s^{-1}\ m^{-2}\ K^{-1}$. A convection heat transfer coefficient is a heat transfer coefficient due to convection. For purposes of this specification and the claims presented herein, these coefficients are to be evaluated under approximately steady state thermal conditions in a temperature range of about 300° C. to 1000° C. and a temperature difference between the hot working fluid and the cooling fluid 26 of at least 600° C.

An insulating ceramic layer (not shown on FIG. 1), may be present on the front (heated) surface 21 of the CMC layer 22 in both the prior art and in the present invention to slow the heat input Q, and thus reduce cooling requirements. Such a layer does not eliminate but does serve to reduce the thermal gradient problem described above.

Figure 2:
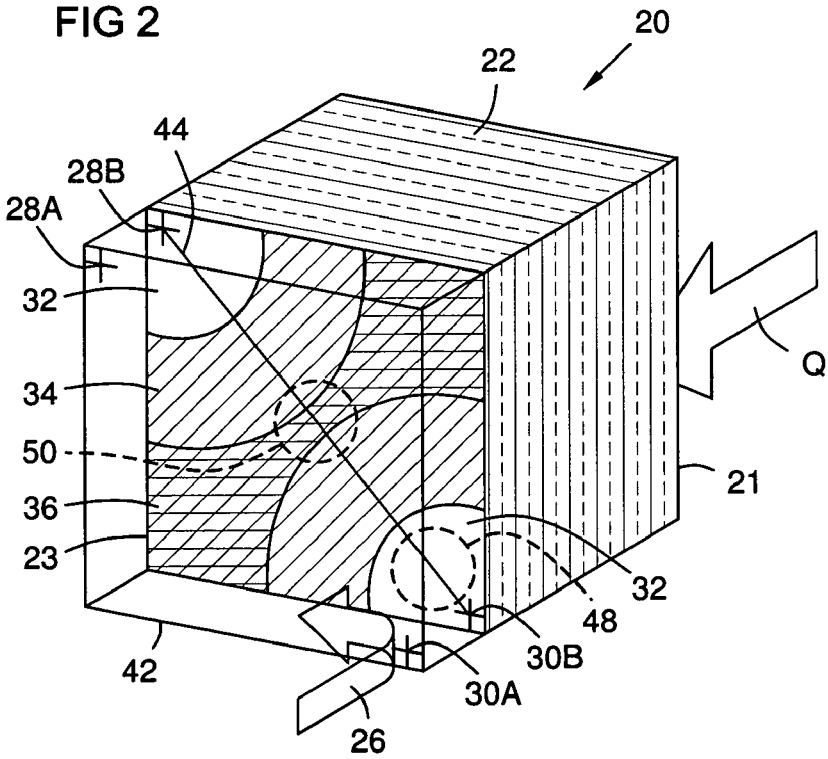
FIG. 2 is a view as in FIG. 1 modified according to the invention with a conductive layer on the cooled side of the CMC wall, showing a reduction of thermal gradients on the cooled side of the CMC wall.

FIG. 2 is a view as in FIG. 1, but is modified according to the present invention with a lateral heat transfer member such as thermally conductive layer 42 applied to the cooled side of the CMC material 22. The term "thermally conductive" is used herein in a relative sense to mean that the thermally conductive material has an in-plane (lateral) coefficient of thermal conductivity at least 10 times greater than a corresponding in-plane coefficient of thermal conductivity of the CMC material. The term "applied to" means affixed in any manner effective to provide the desired heat transfer, and will typically include depositing the layer 42 directly onto the CMC material 22 such as by brazing, thermal spraying, cold spraying, vapor deposition, etc. The presence of the conductive layer does not alter the locally high convection coefficients, but provides a path for lateral heat conduction toward the highly cooled areas, thus mitigating their adverse effects. The resultant temperature gradient at the cooled surface 23 of the CMC material is represented in FIG. 2 by fewer and wider hatched bands 32 to 36. Two measurement areas 48 and 50 are illustrated. These represent any two areas on the cooled side 23 of the CMC that are desired to be maintained within a more narrow temperature range than permitted with prior art impingement cooling methods. Temperature profiles and thermal gradients may be measured or calculated for conductive heat transfer from the CMC 22 to the conductive layer 42 and/or for convective heat transfer from the conductive layer 42 to the cooling fluid 26. Impingement points 28A and 30A are shown on the thermally conductive layer 42. Respective points 28B and 30B directly below the impingement points are shown on the CMC back surface 23. A line 44 may be drawn between two impingement points 28A-30A or between respective points 30A-30B to obtain a temperature profile for a given impingement heat transfer coefficient specification. Otherwise, the measurement areas 48 and 50 may be chosen in any two positions, including positions producing a worst-case (largest) ratio of heat transfer coefficients.

Figure 3:
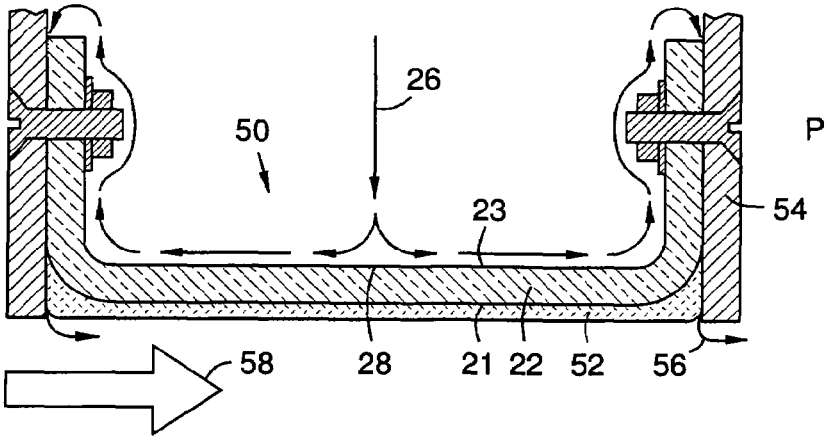
FIG 3 PRIOR ART
FIG. 3 is a prior art sectional view of a turbine shroud ring segment taken on a plane of the turbine shaft axis, showing impingement cooling.

FIG. 3 is a sectional view of a prior art gas turbine shroud ring segment 50 taken on a plane of the turbine shaft axis. The ring segment 50 may have a CMC wall 22 with a front surface 21 coated with an insulating layer 52. One or more impingement cooling fluid flows 26 are directed against the back surface 23 of the CMC wall 22, where they spread from impingement point(s) 28. The ring segment 50 may be mounted on a mounting ring 54. The cooling flow 26 may exit the system by flowing as shown at 56 through clearances between ring segments and mounting rings 54 or between adjacent ring segments into the hot working gas 58. The cooling flow 26 may have a higher pressure than the working gas 58, to prevent the working gas 58 from escaping the enclosing turbine shroud between the ring segments.

Figure 4:
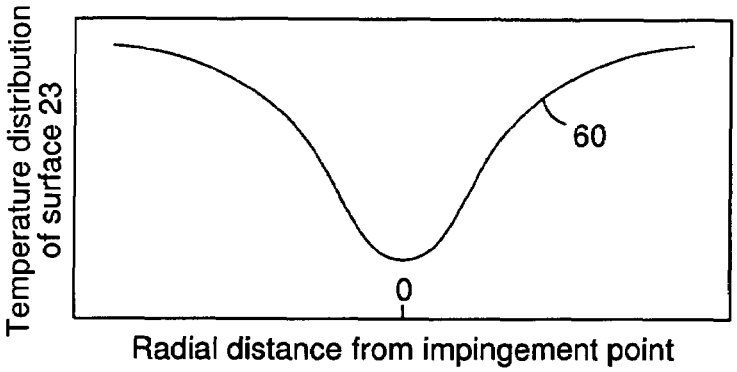
FIG 4 PRIOR ART
FIG. 4 illustrates the shape of a convective coefficient curve as a function of radial distance from an impingement point such as occurs in the prior art of FIG. 3.
Figure 5:
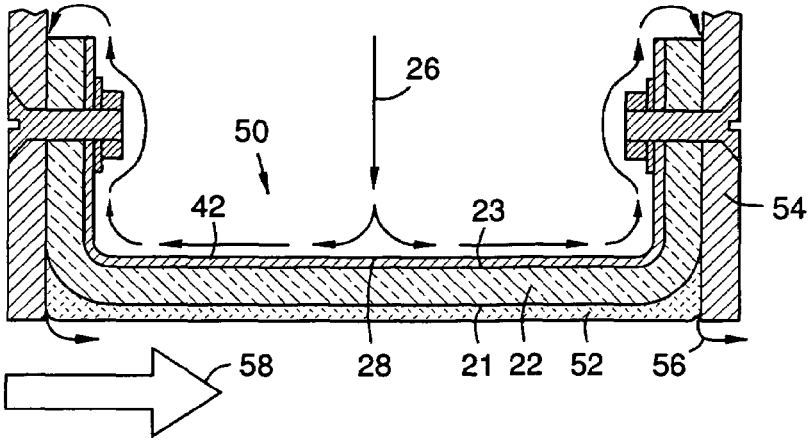
FIG. 5 is a sectional view as in FIG. 3 modified according to the invention with a conductive layer on the cooled side of the wall.
Figure 6:
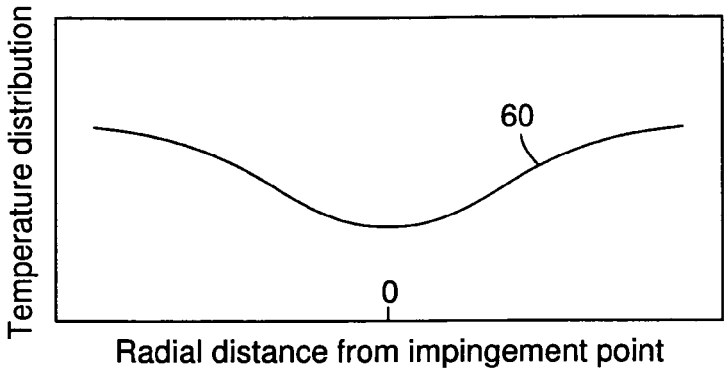
FIG. 6 illustrates the shape of a convective coefficient curve as a function of radial distance from an impingement point such as occurs in the invention of FIG. 5.

FIG. 4 illustrates the shape of a temperature distribution curve 60 as a function of distance from an impingement point 28 such as occurs in the prior art of FIG. 3. Curve 60 follows a generally inverted bell-shaped distribution with an undesirably low peak and high tails. In a representative case, the temperature variation in curve 60 may exceed several hundred degrees Celsius, resulting in high thermal stresses. FIG. 5 is a sectional view as in FIG. 3 modified according to the invention with a thermally conductive layer 42 on the cooled side 23 of the CMC wall 22. This modification smoothes the temperature distribution curve 60 as shown in FIG. 6, raising and widening the peak, and lowering the tails significantly and thus lowering the resultant thermal stresses.

Figure 7:
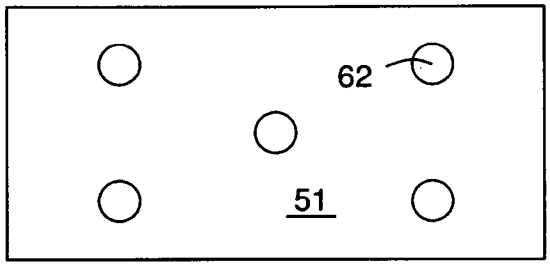
FIG. 7 shows an example of an impingement cooling hole pattern in a shroud ring segment cooling flow injector.
Figure 8:
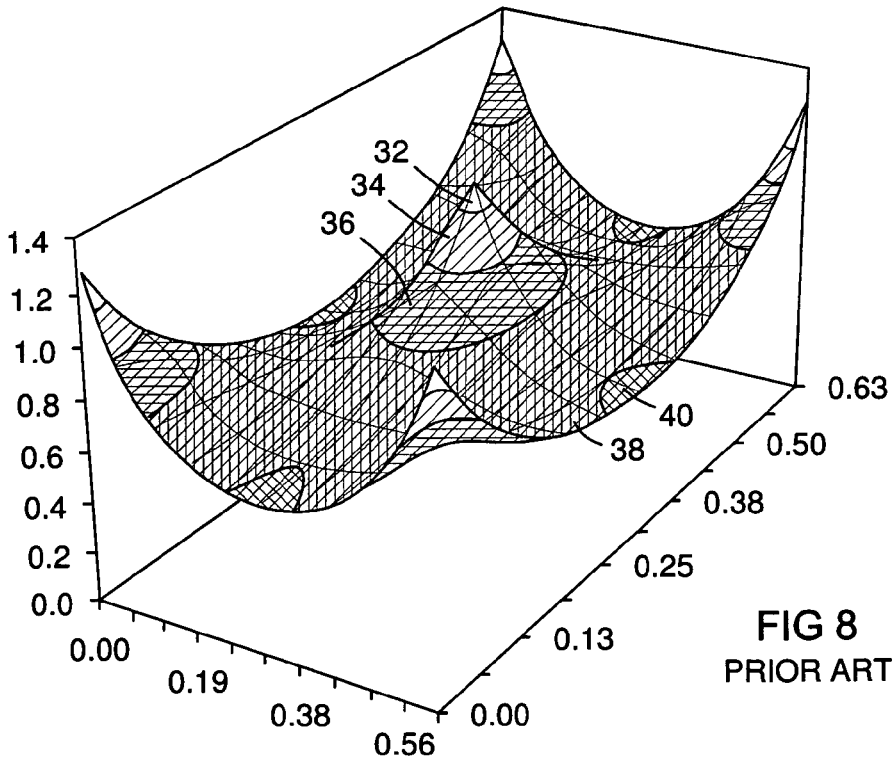
FIG 8 PRIOR ART
FIG. 8 is a 3-dimensional representation of convection coefficients for the cooling hole pattern of FIG. 7 in the prior art, showing a peak for each cooling hole.

FIG. 7 shows multiple cooling air injection holes 62 in a cooling flow injector plate 51 that is mounted just outboard of each ring segment 50. FIG. 8 is a 3-D representation of convection coefficients such as result from a pattern of cooling holes 62 as in FIG. 7 in the prior art, showing a sharp peak for each hole 62. With the present invention each peak is smoothed as in FIG. 6.

FIG. 9 is a sectional view of a prior art turbine airfoil 70, with a cooling air plenum 76 in a solid core 74, and CMC walls 22 with an insulating layer 52, showing cooling supply at the leading edge 72 branching into cooling channels 78 along the walls 22 and exiting the trailing edge 80. In this geometry, the 3-D convection coefficient function has a sharp peak at area 73, which represents the transition between the large plenum chamber 76 and the smaller cooling channels 78. This high heat transfer coefficient results in locally high temperature gradients and thermally-induced stresses in this region. Likewise, use of multiple channels 78 in the chord wise direction, results in an uneven temperature distribution across the blade in a direction perpendicular to the plane of the illustration of FIG. 9. FIG. 10 is a view as in FIG. 9 modified according to the invention with a conductive layer 42 on the inner (cooled) surface of the blade walls 22. This reduces the effects of the leading edge peak cooling coefficient and the uneven temperature distribution between cooling channels 78, and results in a more even temperature distribution across the blade.

In addition to providing an improved heat transfer function, the material of the conductive layer 42 may provide a structural function as well. The conductive layer 42 may provide a compatible surface for attaching a structure to the CMC wall. For example, if the layer 42 is metallic, then features such as seals can be brazed or otherwise bonded to, or formed to be integral with, the layer 42. FIG. 11 shows a sectional view of a CMC wall 22 with a thermally conductive layer 42 bonded to a fluid seal 82. The conductive layer 42 may be formed on and bonded to the CMC layer 22 by methods such as physical vapor deposition, slurry application with sintering, braze pastes and foils designed to wet oxide ceramics, plasma spraying, or other coating or application methods. In addition, the conductive layer may be added by bonding processes. The fluid seal 82 may be formed to be integral with the conductive layer 42 or it may be separately joined to the conductive layer 42. Such seals include, but are not limited to E-seals, C-seals, rope seals, U-plex seals and other similar sealing devices. Thus, the conductive layer 42 may be used for heat transfer and for mechanical load transfer with the CMC wall.

Materials for the thermally conductive layer 42 may include high thermal conductivity metals and metal alloys such as silicon, silver, nickel alloys and copper alloys, nonmetallics such as beryllia, (BeO), silicon carbide (SiC) and titanium carbide (TiC) and other high thermal conductivity ceramics, cermets, metal matrix composites, and/or other thermally conductive materials, for example. The relatively low temperature requirement for the conductive layer 42, which is typically exposed to cooling air at less than 500° C. in a gas turbine application, expands the choice of materials and expands the number of processes that can be used to apply the coating 42. For example, in lower temperature environments, boron nitride and pyrolytic graphite may be good candidates. In one embodiment the layer 42 is a braze material applied by any known brazing process. The braze metal may contain any high thermal conductivity element, such as silver, copper and silicon for example. Such brazing compositions are commercially available from Wesgo Metals under the trademarks Cusil-ABA®, Incusil-ABA™, AND Copper-ABA®. Also, the relatively low thickness required for the coating layer allows for some mismatch in the coefficients of thermal expansion of the CMC material and the coating. Coatings 42 may be locally applied, such as by masking, or may be globally applied. The coating process may be performed following a final CMC firing cycle. The coating composition may be tailored to meet particular component requirements. Different coating compositions may be used on different areas of the same component to satisfy different requirements. The coating 42 may be a metal or metal alloy having a thickness of between 100-1000 microns or between 200-500 microns in various embodiments.

The thermally conductive layer 42 functions as a heat transfer path or conduit for moving thermal energy from an area of lower heat transfer, such as area 50 of FIG. 2, to an area of higher heat transfer, such as area 48 of FIG. 2. The CMC material 22 alone is limited in its ability to conduct heat from the area of lower heat transfer to the area of higher heat transfer due to its inherent low coefficient of thermal conductivity. The present invention allows heat energy to flow out of the surface 23 of the CMC material 22 in areas of high temperature/low heat transfer coefficients 50 and laterally through the thermally conductive material toward the areas of lower temperature/high heat transfer coefficients 48. In other words, the heat energy traveling through the thickness of the CMC material 22 to the midway surface point 50 can be conducted laterally through the coating material 22 toward the heat sinks at the impingement points 28A, 30A without a deleteriously high temperature gradient because of the high thermal conductivity of the coating material 22. Accordingly, the layer of conductive material 42 may be selected to have a thickness that is adequate to transfer the flow of heat energy Q in the lateral direction (parallel to surface 23) to maintain a desired relatively low temperature differential $\Delta T$ across the back surface 23. Because conductive layer 42 has a much higher thermal conductivity than does the CMC material 22, the required thickness of the layer 42 is relatively small compared to the thickness of the CMC material 22 in the direction perpendicular to the heated surface 21. The conductivity-to-thickness ratio for the layer 42 $(k/t)_{coating}$ $W/m^2K$ may be at least 20 times or 50 times that of the conductivity-to-thickness ratio of the CMC wall 22 $(k/t)_{CMC}$ $W/m^2K$. For lower ratios, the thermally conductive coating may either be ineffective (conductivity too low) or impractical (thickness greater than required). Preferably, the conductivity-to-thickness ratio for the layer 42 is between 20 to 2000 times that of the conductivity-to-thickness ratio of the CMC wall 22. The most practical range for gas turbine applications is between 50 to 1000 times. In one embodiment, for a ratio of 800:1 $(k/t)_{coating}:(k/t)_{CMC}$, the lateral heat flow is increased by a factor of 5 over the CMC alone. The general applicability of these ranges is contemplated under the following conditions for gas turbine applications: approximately steady state thermal conditions in a temperature range of about 300° C. to 1000° C. and a temperature difference between the hot working fluid and the cooling fluid 26 of at least 600° C. Furthermore, the CMC wall structures contemplated for use with this invention in gas turbine applications may exhibit a conductivity-to-thickness (k/t) ratio within the range of 200-2,000 $W/m^2K$.

While various embodiments of the present invention have been shown and described herein, it will be obvious that such embodiments are provided by way of example only. Numerous variations, changes and substitutions may be made without departing from the invention herein. For example, the lateral heat transfer member is described herein as a coating, although other embodiments such as heat tubes, heat exchangers, and various types of heat pumps may be beneficial for certain applications. Accordingly, it is intended that the invention be limited only by the spirit and scope of the appended claims.

The invention claimed is:

1. A cooling arrangement for a component, comprising:

a component wall comprising first and second layers;

the first layer comprising a CMC material comprising a heated front surface and a cooled back surface;

the second layer comprising a thermally conductive material disposed on the back surface of the first layer, the thermally conductive material comprising a coefficient of thermal conductivity at least 10 times greater than a corresponding coefficient of thermal conductivity of the CMC material; and a cooling fluid flow that impinges on a cooled back surface of the second layer opposite the first layer;

wherein the component is a gas turbine shroud ring segment, the front surface of the first layer is a radially inner surface with respect to an axis of the gas turbine, the second layer comprises a coating on the back surface of the first layer, and further comprising a cooling air injector comprising a plurality of cooling air injection holes that produce a plurality of cooling airflows that impinge against the back surface of the second layer.

2. The cooling arrangement as in claim 1, further comprising a conductivity-to-thickness ratio for the second layer being at least 20 times that of a conductivity-to-thickness ratio of the first layer.

3. The cooling arrangement as in claim 1, further comprising a conductivity-to-thickness ratio for the second layer being at least 50 times that of a conductivity-to-thickness ratio of the first layer.

4. The cooling arrangement as in claim 1, further comprising a conductivity-to-thickness ratio for the second layer being within a range of 50-1,000 times that of a conductivity-to-thickness ratio of the first layer.

5. The cooling arrangement as in claim 2, wherein the second layer comprises a metal or metal alloy comprising a thickness of between 100-1000 microns.

6. The cooling arrangement as in claim 1, further comprising a structure attached to or formed integral with the second layer.

7. The cooling arrangement as in claim 6, wherein the structure comprises a compressible seal.

8. The cooling arrangement as in claim 1, wherein the CMC material comprises an oxide/oxide CMC material and the thermally conductive material comprises at least one of the group consisting of silicon, silver, nickel alloys, copper alloys, beryllia, silicon carbide, titanium carbide, boron nitride and pyrolytic graphite.

9. A cooling arrangement for a component, comprising:

a ceramic matrix composite (CMC) wall comprising a front heated surface and a back cooled surface and a thickness there between;

an insulating layer on the front heated surface of the CMC wall;

a lateral heat transfer layer applied to the back cooled surface of the ceramic matrix composite wall;

wherein the lateral heat transfer layer is thinner than the CMC wall, has a higher conductivity-to-thickness ratio than the CMC wall, and does not contain internal cooling channels; and a cooling fluid flow that impinges directly on a back surface of the lateral heat transfer layer opposite the CMC wall.

10. The cooling arrangement as in claim 9, further comprising a conductivity-to-thickness ratio of the lateral heat transfer layer being at least 20 times that of a conductivity-to-thickness ratio of the ceramic matrix composite wall.

11. The cooling arrangement as in claim 9, further comprising a conductivity-to-thickness ratio of the lateral heat transfer layer being within a range of 50-1,000 times that of a conductivity-to-thickness ratio of the ceramic matrix composite wall.

12. The cooling arrangement as in claim 9, further comprising a coefficient of thermal conductivity of the lateral heat transfer layer being at least 10 times greater than a corresponding coefficient of thermal conductivity of the ceramic matrix composite wall.

13. The cooling arrangement as in claim 9, wherein the lateral heat transfer layer comprises a layer of metal applied to the cooled surface of the ceramic matrix composite wall.

14. The cooling arrangement as in claim 9, further comprising a compressible seal structure bonded to the lateral heat transfer layer.

15. A cooling arrangement for a gas turbine airfoil, comprising:

a component wall comprising first and second layers;

the first layer comprising a CMC material comprising a heated front surface and a cooled back surface;

the second layer comprising a thermally conductive material disposed on the back surface of the first layer, the thermally conductive material comprising a coefficient of thermal conductivity at least 10 times greater than a corresponding coefficient of thermal conductivity of the CMC material;

a cooling fluid flow that impinges on a cooled back surface of the second layer opposite the first layer;

wherein the first layer comprises an airfoil shape with a leading edge and a trailing edge, the front surface of the first layer is a heated surface of the airfoil, the second layer comprises a coating on an interior surface of the airfoil shape defining an interior space;

a cooling air plenum proximate the leading edge of the airfoil; and cooling air channels extending from the cooling air plenum and passing along the second layer from the leading edge toward the trailing edge.

* * * * *

UNITED STATES PATENT AND TRADEMARK OFFICE

CERTIFICATE OF CORRECTION

PATENT NO. : 7,641,440 B2
APPLICATION NO. : 11/514745
DATED : January 5, 2010
INVENTOR(S) : Morrison et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 623 days.

Signed and Sealed this

Sixteenth Day of November, 2010

David J. Kappos

David J. Kappos
*Director of the United States Patent and Trademark Office*